US011772349B2

(12) United States Patent
Ruch et al.

(10) Patent No.: US 11,772,349 B2
(45) Date of Patent: Oct. 3, 2023

(54) PRESSING TOOL FOR PRESSING WORKPIECES

(71) Applicant: Von ARX AG, Sissach (CH)

(72) Inventors: Matthias Ruch, Efringen-Kirchen (DE); Rudolf Kreuzer, Buchs (CH)

(73) Assignee: EMERSON PROFESSIONAL TOOLS AG, Sissach (CH)

( * ) Notice: Subject to any disclaimer, the term of this patent is extended or adjusted under 35 U.S.C. 154(b) by 496 days.

(21) Appl. No.: 16/663,622

(22) Filed: Oct. 25, 2019

(65) Prior Publication Data

US 2020/0130313 A1 Apr. 30, 2020

(30) Foreign Application Priority Data

Oct. 25, 2018 (EP) ..... 18202607

(51) Int. Cl.
*B30B 15/16* (2006.01)
*B25B 27/02* (2006.01)
(Continued)

(52) U.S. Cl.
CPC ..... *B30B 15/166* (2013.01); *B21D 39/048* (2013.01); *B25B 27/026* (2013.01); *B25F 5/005* (2013.01); *B30B 15/0094* (2013.01)

(58) Field of Classification Search
CPC . B30B 15/0094; B30B 15/166; B21D 39/048; B25B 27/026; B25F 5/005;
(Continued)

(56) References Cited

U.S. PATENT DOCUMENTS 8,864,101 B1 * 10/2014 Buckner ..... F16K 31/00 251/59
2003/0102140 A1 * 6/2003 Giardino ..... B25B 23/1405 173/176
(Continued)

FOREIGN PATENT DOCUMENTS

CN 203031970 U 7/2013
EP 941812 A1 * 9/1999 ..... B25F 5/005
(Continued)

OTHER PUBLICATIONS

CN Office Action dated Mar. 26, 2021; Application No. 2019110223174; 10 pages.

*Primary Examiner* — Katrina M Stransky
*Assistant Examiner* — Jared O Brown
(74) *Attorney, Agent, or Firm* — Mark E. Bandy; Rankin Hill & Clark, LLP

(57) ABSTRACT

A pressing tool for pressing workpieces is described. The pressing tool comprises a hydraulic pump for conveying a hydraulic fluid, an electric motor for driving the hydraulic pump, a working cylinder which is hydraulically connected to an outlet of the hydraulic pump, a pressure-relief valve which is hydraulically connected to the outlet of the hydraulic pump and which opens at a certain predefined pressure $P_v$ of the hydraulic fluid, an electronic control for controlling the electric motor and a sensor 60 which monitors the state of the pressure-relief valve and emits a signal which describes the state of the pressure-relief valve to the electronic control. Furthermore, a method of operating such a pressing tool is described.

14 Claims, 2 Drawing Sheets

(51) Int. Cl.
*B25F 5/00* (2006.01)
*B30B 15/00* (2006.01)
*B21D 39/04* (2006.01)

(58) Field of Classification Search
CPC ..... H01R 43/042; H01R 43/0427; H01R 43/0428; Y10T 29/53226
See application file for complete search history.

(56) References Cited

U.S. PATENT DOCUMENTS

| | | | | |
|---|---|---|---|---|
| 2005/0005672 | A1* | 1/2005 | Sneath | H01R 43/0427 72/453.16 |
| 2006/0156786 | A1* | 7/2006 | Lefavour | B25B 27/10 72/453.16 |
| 2014/0159920 | A1* | 6/2014 | Furui | B25F 5/00 340/870.07 |
| 2016/0332358 | A1* | 11/2016 | Dickert | B29C 57/045 |
| 2018/0093319 | A1* | 4/2018 | Skinner | B25B 27/026 |
| 2021/0252316 | A1* | 8/2021 | Sauerbrier | B25F 5/005 |

FOREIGN PATENT DOCUMENTS

| | | | | |
|---|---|---|---|---|
| EP | 1230998 | A2 * | 8/2002 | B25B 27/10 |
| EP | 1 337 016 | A2 | 8/2003 | |
| EP | 1 403 528 | A1 | 3/2004 | |
| EP | 2 228 178 | A2 | 9/2010 | |
| EP | 2 501 523 | A1 | 9/2012 | |
| EP | 3 243 604 | A1 | 11/2017 | |
| WO | WO-2011042008 | A1 * | 4/2011 | F04B 5/02 |

* cited by examiner

PRESSING TOOL FOR PRESSING WORKPIECES

FIELD

The present invention relates to a pressing tool, particularly a hand-held pressing tool, for pressing workpieces, and a method of operating a pressing tool.

BACKGROUND

In the prior art, methods of pressing workpieces, for example tubular workpieces, particularly pipes in installation engineering, are known. In a known method, two pipes are inseparably connected to each other by means of a compression fitting. For this purpose, the pipes are inserted into the ends of a compression fitting which comprises polymer seals for providing a seal against the pipes. After the pipes to be joined together have been inserted, the compression fitting is compressed by means of a suitable pressing tool, i.e. plastically deformed in such a way that the inserted pipes may no longer be pulled out and are safely sealed by the seals.

The pressing is performed by means of a hand-held and motor-powered pressing tool which may comprise interchangeable tools such as pressing jaws of different sizes and geometries, for example. Apart from that, pressing tools are also known for different tasks. For example, pressing tools are used to press, crimp or cut workpieces, for example in the electronics industry for joining cable lugs and cables together.

In case of a hand-held pressing tool, the pressing jaws are arranged around the compression fitting for pressing. For closing the pressing jaws, a user actuates an operation push button and, thereby, starts up an electrically driven hydraulic pump. The latter generates a pressure in a hydraulic fluid which acts upon a driving piston. The driving piston generates a high pressing force which is applied to the surface of the compression fitting by means of pressing pliers, so that it is radially compressed and plastically deforms. Due to the plastic deformation of the compression fitting, the workpieces, e.g. the compression fitting and the tube, are safely joined together. In the course of this, the inner tubes may also be plastically deformed.

In pressing tools of the prior art, the pressing process is usually ended by a pressure-relief valve opening when a certain maximum pressure is reached, hydraulic pressure decreases and the driving piston returns to its initial position. The defined maximum pressure ensures that a suitably high pressing force was applied to the workpiece in order to guarantee sufficient compression. When the end of the pressing process is reached, the operator may release the operation push button and switch off the electric motor of the hydraulic pump. Such a manual control of the hydraulic pump by the operator may cause unnecessary consumption of electric power and require that the operator presses the operation push button until the pressing process ends. If the operator releases the operation push button before the pressing process ends, it is not ensured that sufficient pressing of the workpieces has already taken place. From document EP 2,501,523B1, a manually guided press device for connecting a press fitting in installation engineering and for pressing cable lugs is known. For the purpose of generating the required high pressing forces the pressing tool is connected to an electro-hydraulic converter. A brushless electric motor is used as a drive motor. As soon as the required pressing force is reached, a pressure-relief valve opens, which causes the motor speed to surge. This increase in motor speed is recognized by a control of the pressing device, whereupon the electric motor is switched off. Hence, such a pressing device requires a sophisticated monitoring and analysis of the motor speed.

Therefore, it is the object of the present invention to provide a pressing tool which overcomes the disadvantages mentioned above and has a simple and effective control. Furthermore, a corresponding method of operating a pressing tool is to be provided.

SUMMARY

The difficulties and drawbacks associated with previous approaches are addressed in the present subject matter as follows.

In one aspect, the present invention provides a pressing tool for pressing workpieces. The pressing tool comprises a hydraulic pump for conveying a hydraulic fluid. The pressing tool also comprises an electric motor for driving the hydraulic pump. The pressing tool additionally comprises a working cylinder which is hydraulically connected to an outlet of the hydraulic pump. The pressing tool also comprises a pressure-relief valve which is hydraulically connected to the outlet of the hydraulic pump and which opens at a certain predefined pressure ($P_v$) of the hydraulic fluid. The pressing tool further comprises an electronic control for controlling the electric motor. And, the pressing tool comprises a sensor which monitors the state of the pressure-relief valve and emits a signal which describes the state of the pressure-relief valve to the electronic control.

In another aspect, the present invention provides a method of operating a pressing tool for pressing a workpiece. The method comprises driving a hydraulic pump by means of an electric motor. The method also comprises conveying a hydraulic fluid by means of the hydraulic pump. The method also comprises opening a pressure-relief valve which is hydraulically connected to the outlet of the hydraulic pump at a certain predefined pressure ($P_v$) of the hydraulic fluid. The method further comprises monitoring the state of the pressure-relief valve by means of a sensor. The method also comprises emitting a signal to an electronic control, wherein the signal describes the state of the pressure-relief valve. And, the method comprises controlling the electric motor by means of the electronic control based on the signal.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
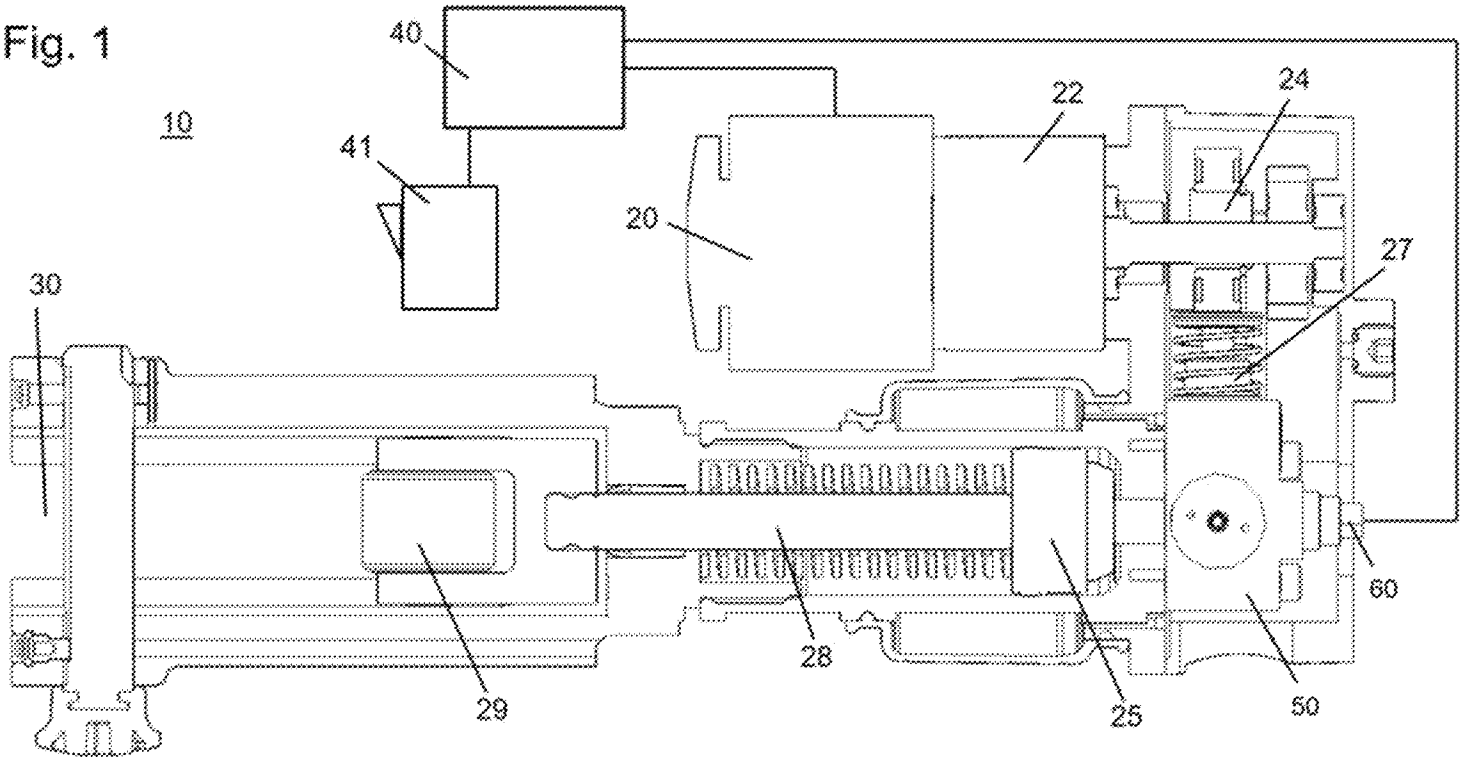
FIG. 1 shows a schematic illustration of an embodiment of a pressing tool in the form of a hydraulic hand-held pressing device according to the present invention.

In particular, the aforementioned problems are solved by a pressing tool for pressing workpieces, comprising a hydraulic pump for conveying a hydraulic fluid, an electric motor for driving the hydraulic pump, a driving piston which is hydraulically connected to an outlet of the hydraulic pump, a pressure-relief valve which is hydraulically connected to the outlet of the hydraulic pump and which opens at a certain predefined overpressure of the hydraulic fluid, an electronic control for controlling the electric motor, and a sensor which monitors the state of the pressure-relief valve and emits an electrical signal which describes the state of the pressure-relief valve to the electronic control.

Due to the monitoring of the state of the pressure-relief valve by the sensor, the electronic control recognizes the state of the pressure-relief valve, for example whether it is closed or opened, and may correspondingly control the pressing tool. In particular, the pressing process, thus, may automatically be carried out completely as the control operates the electric motor until the pressure-relief valve is triggered and then stops the electric motor. In this way, it is ensured that the necessary pressing pressure is achieved, and electric power is saved as the electric motor is only operated as long as it is necessary. This is advantageous in pressing tools powered by rechargeable batteries, in particular. Apart from that, it may be recognized whether the required pressing pressure was reached or not in case of a manual control of the pressing tool by the user.

Preferably, the pressure-relief valve comprises a movable valve piston which is preloaded against a valve seat by means of a spring. A spring-preloaded pressure-relief valve is particularly reliable in operation and allows setting a desired trigger pressure by setting the preload of the spring.

Preferably, the sensor comprises a magnetic sensor which is influenced by a magnet at the pressure-relief valve. A magnetic actuation of the sensor is particularly reliable and may easily be realized. For this purpose, only a magnet has to be attached to a movable part of the pressure-relief valve, for example the valve piston. The magnet, which then moves together with the valve piston, has an effect on the magnetic sensor due to its magnetic field, without any mechanical or electrical contact being required. This increases the reliability of the detection and of the pressing tool overall. Moreover, the hall effect sensor itself may also include a magnet, wherein the recognition takes place by the change of the magnetic field in that case, e.g. by the movement of a piston that is designed to be ferromagnetic.

Preferably, the magnetic sensor comprises a hall effect sensor. The magnetic sensor may comprise a hall effect sensor which may very reliably detect a magnetic field. In this context, the output signal depends on the size of the magnetic field, so that the distance between the magnet and the hall effect sensor may continuously be sensed. This makes a particularly precise and reliable detection of the state of the pressure-relief valve possible because both the closed and the opened state of the pressure-relief valve may be captured by an unambiguous electrical signal.

Preferably, the magnetic sensor comprises a reed switch. A reed switch is a particularly cost effective kind of magnetic sensor.

Preferably, the magnetic sensor comprises an inductive sensor. When an inductive sensor is used, the change of a magnetic field may preferably be sensed. Here, the moving magnet at the pressure-relief valve preferably induces a voltage in an inductive sensor, for example a coil. This voltage may be detected by the control.

Preferably, the valve piston comprises a permanent magnet. By means of a permanent magnet at the valve piston, the state of the pressure-relief valve may be detected in a particularly simple manner. When the pressure-relief valve opens or closes, the permanent magnet moves together with the valve piston, which causes the magnetic field generated by the permanent magnet to change in relation to a stationary magnetic sensor. This magnetic field or the change of the magnetic field may be detected by the magnetic sensor.

Preferably, the valve piston may also include an inversely arranged magnet, for example a permanent magnet, which increases signaling reliability in combination with another magnetic sensor. Here, the open position of the valve piston may be actively detected by means of the first magnetic sensor, for example, and the closed position of the valve piston may be actively detected by the second magnetic sensor, for example. This means that precisely defined signals are received by the control for both states of the pressure-relief valve, and controlling the pressing tool becomes insusceptible to magnetic fields interfering from the outside.

Preferably, both the normally arranged magnet and the inversely arranged magnet may also be an electromagnet which only generates a magnetic field after the pressing process has been started. In this way, the control may already analyze the signals of the magnetic sensors in an idle mode and compare them to those after the start. This makes it possible to recognize and filter out interfering signals from magnetic fields interfering from the outside.

Preferably, the sensor comprises an optical sensor. The state of the pressure-relief valve may also be optically detected. In this context, an optical sensor is used which preferably reacts to a change in the incidence of light because of a mechanical motion of the valve piston. For example, an orifice plate which enters into the gap of a fork light sensor when the valve piston shifts might be attached at the valve piston.

Preferably, the sensor comprises an electric switch. An electric switch is a particularly cost-effective kind of sensor. For example, the electric switch may be arranged in such a manner that the valve piston directly influences the electric switch when it shifts.

Preferably, the sensor comprises a capacitive sensor. Monitoring the state of the pressure-relief valve may also take place in a capacitive way. For this purpose, a capacitive sensor may be formed, for example by the valve piston forming a movable part, and a stationary electrode forming a stationary part of a capacitive sensor. Then, the distance between the valve piston and the electrode may be determined by determining the electric capacitance between the valve piston and the electrode and, hence, the switching state of the pressure-relief valve may be determined.

Preferably, the electric motor is a brushless DC motor. Such a brushless DC motor may be controlled very precisely and is very low maintenance while providing a high performance at the same time.

The aforementioned problems are further solved by a method of operating a pressing tool for pressing a workpiece, comprising the following steps:

1. Driving a hydraulic pump by means of an electric motor;
2. conveying a hydraulic fluid by means of the hydraulic pump;
3. opening a pressure-relief valve which is in hydraulic connection with the outlet of the hydraulic pump at a certain predefined over pressure of the hydraulic fluid;
4. monitoring the state of the pressure-relief valve by means of a sensor;
5. emitting an electrical signal to an electronic control, wherein the signal describes the state of the pressure-relief valve; and 6. controlling the electric motor by the electronic control based on the signal.

By the method according to the invention, the electronic control may also monitor the state of the pressure-relief valve and determine whether it is closed or opened and may accordingly control the pressing tool. In particular, the pressing process, thus, may be carried out completely as the control operates the electric motor until the pressure-relief valve is triggered and then stops the electric motor. This ensures that the required pressing pressure is reached. Additionally, electric power is saved as the electric motor is only operated as long as necessary by the control.

Preferably, the method comprises the step of determining the distance between a movable part of the pressure-relief valve and a part that is stationary with respect to the pressing tool by the sensor. Via the distance of a part of the pressure-relief valve, particularly the valve piston, and a part that is stationary with respect to the pressing tool, the state of the pressure-relief valve may be determined in a particularly simple and reliable manner.

Preferably, the step of determining the distance takes place:

a. in an optical manner, wherein the sensor comprises an optical sensor;
b. in a magnetic manner, wherein the sensor comprises a magnetic sensor;
c. in a magnetic manner, wherein the sensor comprises a hall effect sensor;
d. in a magnetic manner, wherein the sensor comprises a reed switch;
e. in an inductive manner, wherein the sensor comprises an inductive sensor;
f. in an electro-mechanical manner, wherein the sensor comprises an electric switch; and/or
g. in a capacitive manner, wherein the sensor comprises a capacitive sensor.

Preferably, the sensor may detect both the closed and the opened state of the pressure-relief valve. In this way, the reliability of the control increases because even the failure of the sensor or a disturbance in the connection between the sensor and the control may be detected. Additionally, interfering influences by external magnetic fields may be recognized and filtered out in this way.

Preferably, instead of one single sensor, two or more sensors may also be used for this purpose.

Preferably, the sensor may continuously detect the distance between the movable part of the pressure-relief valve and the part that is stationary with respect to the pressing tool. Continuously determining the distance makes a continuous electronic adjustment of the detection threshold for the states of the pressure-relief valve possible. Therefore, no mechanical adjustments at the sensor are necessary.

Below, preferred embodiments of the present invention will be described in detail with reference to the enclosed figures.

FIG. 1 shows an embodiment of a hydraulic hand-held pressing device/tool 10 with a hydraulic force transmitting unit. In the hydraulic hand-held pressing device, an electric motor 20 drives an eccentric 24 via a transmission 22 to which the eccentric is connected. Preferably, the electric motor 20 is a brushless DC motor which is supplied with electricity modulated accordingly from a rechargeable battery or a wired power supply (not shown) by a control 40. A common DC motor 20 with a commutator may also be used. The transmission 22 reduces the speed of the electric motor 20 and increases the torque for actuating a hydraulic pump 27. The eccentric 24 connected to the transmission converts the rotary motion of the output shaft of the transmission 22 into a one-dimensional oscillating motion in order to drive the hydraulic pump 27 which is embodied as a piston pump.

The hydraulic pump 27 pumps a hydraulic fluid 70 into a working cylinder 25 from a reservoir due to its motion, which causes the hydraulic pressure in the working cylinder 25 to rise. The rising hydraulic pressure pushes a driving piston 28 that is guided in a movable manner in the cylinder 25 to the left in the illustration according to FIG. 1, towards the attachment area for interchangeable pressing jaws 30 (not shown in detail). By using a large piston diameter, the driving piston 28 is able to transmit very high pressures to the pressing jaws.

The driving piston 28 is mechanically connected to rollers 29 which move together with the motion of the driving piston 28. The rollers 29 move in the usual manner between inclined ends of pressing jaws 30 which, thus, are closed and may plastically deform the workpiece with a high force. During operation, the hydraulic pressure thus is directly proportionally transmitted to the coupled pressing jaws 30 and applies a pressing force to the workpiece that is directly proportional to the hydraulic pressure.

For the purpose of starting the pressing process, the user may actuate an operation push button 41 which is electrically connected to the control 40. The control 40 recognizes the actuation of operation push button 41 and, in reaction, suitably controls the electric motor 20, so that the latter drives the hydraulic pump 27 via the eccentric 24. The hydraulic pump 27 pumps the hydraulic fluid into the working cylinder 25 at the side of its outlet in order to move the driving piston.

Due to the hydraulic pressure P rising during pressing and, thus, due to the increasing pressing force upon the workpiece and/or the fitting, the workpiece is pressed and plastically deformed.

At the end of the pressing process, the hydraulic pressure has risen to the level of a predefined maximum pressure at which safe pressing of the workpieces is guaranteed. Once the predefined pressure is reached, a pressure-relief valve 50 opens, which causes the hydraulic pressure in the working cylinder 25 to decrease and the driving piston 28 to return to its initial position due to a spring preload.

The opening of the pressure-relief valve 50 when the predefined pressure is reached is detected by a sensor 60 which is associated with the control 40 by signaling technology. Thus, the opening of the pressure-relief valve 50 is signaled to the control 40, so that it may stop the electric motor 20.

Figure 2B:
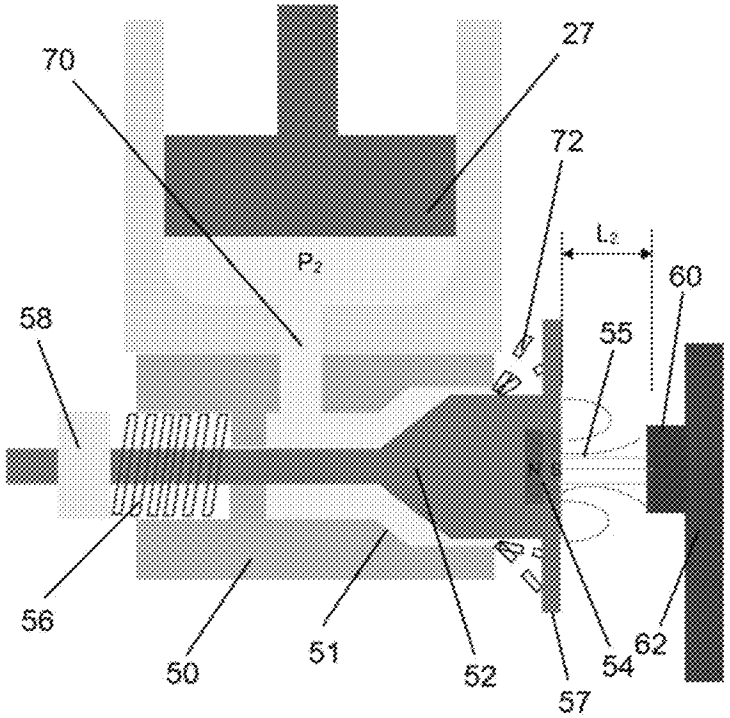
FIG. 2B shows the sectional view of FIG. 2A with an opened pressure-relief valve.
Figure 2A:
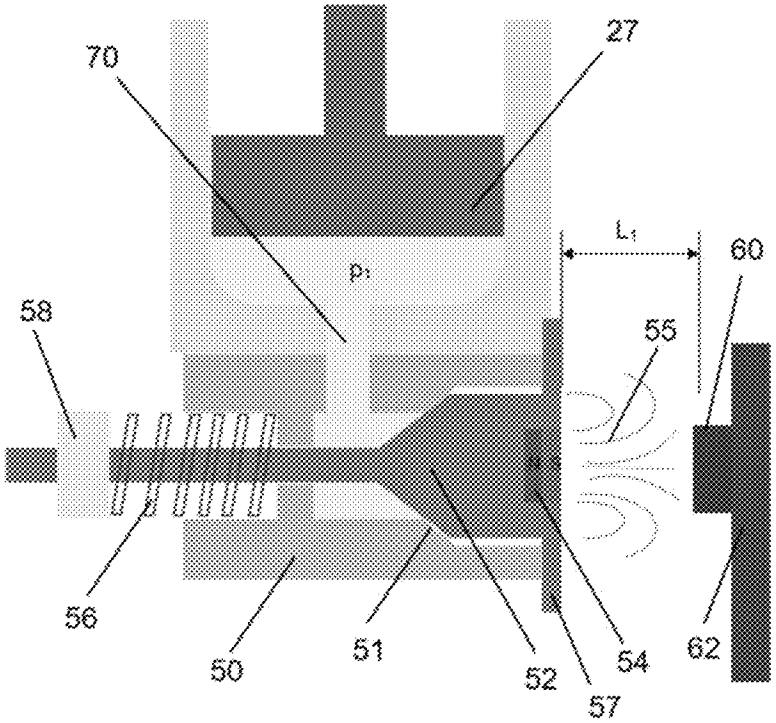
FIG. 2A shows a sectional view of a portion of the pressing tool with a closed pressure-relief valve.

Details of the pressure-relief valve 50 and an exemplary sensor 60 are illustrated in FIGS. 2A and 2B. FIG. 2A shows the pressure-relief valve 50 in its closed state. The pressure-relief valve 50 comprises a movable valve piston 52 which is preloaded against a valve seat 51 by means of a spring 56, a spiral spring in this case. The preload of the spring 56 may be adjusted via an adjusting screw 58 in order to adjust the predefined pressure $P_v$ at which the pressure-relief valve 50 is to open at the end of the pressing process. The pressure-relief valve 50 is hydraulically connected to the outlet of the hydraulic pump 27 and, therefore, is subject the hydraulic pressure that acts upon the working cylinder 25. At a pressure $P_1<P_v$, the pressure-relief valve 50 is closed, with the valve piston 52 sealing the valve seat 51.

At a hydraulic pressure of $P_2>=P_v$, as illustrated in FIG. 2B, the pressure-relief valve 50 opens by the valve piston 52 being shifted to the right against the force of the spring 56. During this process, hydraulic fluid 70 may leak from the annular gap between the valve piston 52 and the valve seat 51 as illustrated by means of the reference number 72. This causes the pressure at the side of the outlet of the hydraulic pump 27 and/or the pressure acting upon the working cylinder 25 to drop, and the driving piston 28 may return to its initial position.

In the embodiment schematically illustrated, the valve piston 52 has a dynamic pressure surface 57 which causes the pressure-relief valve 50 to remain open when hydraulic fluid 72 leaks from the annular gap between the valve piston 52 and the valve seat 51. In this way, the pressure in the working cylinder 25 may decrease to such an extent, and hydraulic fluid 70 may leak to such an extent that the driving piston 28 may return to its initial position.

In an alternative embodiment (not shown), the valve piston 52 does not comprise any dynamic pressure surface 57 and will close the pressure-relief valve 50 again once pressure has decreased enough for this purpose. A deflation of the working cylinder 25 may take place via a separate hydraulic valve (not shown) which may, for example, be electrically controlled by the control 40.

Additionally, it is possible in another alternative embodiment (not shown) that the valve piston 52 does not have any dynamic pressure surface 57, and the control 40 keeps the valve piston 52 in its open position in a controlled manner, for example in an electromagnetic way.

Apart from this, it is possible in another alternative embodiment (not shown) that the valve piston 52 does not have any dynamic pressure surface 57 but mechanically latches into its open position. The latching may be released again once the driving piston 28 has returned to its initial position.

The state of the pressure-relief valve 50 may be monitored by a sensor 60. In particular, the sensor 60 emits an electrical signal to the control 40 when the pressure-relief valve 50 opens after the predefined pressure $P_v$ has been reached. Additionally, the sensor 60 may also emit a different signal when the pressure-relief valve 50 is closed. It is also possible that the sensor 60 emits a corresponding signal when the pressure-relief valve 50 switches from the closed state to the opened state or from the opened state to the closed state.

In the preferred embodiment, the sensor 60 includes a magnetic sensor which is attached to a stationary housing component 62 and is electrically connected to the control 40. The sensor 60 reacts to a magnetic field 55 which is generated by a permanent magnet 54 which is arranged at the end of the valve piston 52. The magnetic field 55 between the permanent magnet 54 and the sensor 60 changes when the valve piston 52 moves during the opening or closing of the pressure-relief valve 50. In this process, the distance between the permanent magnet 54 and the sensor 60 changes from a length $L_1$ in the closed state to a shorter length $L_2$ in the opened state of the pressure-relief valve 50.

Sensor 60 may comprise an inductive sensor with an induction coil which generates an induced voltage that may be analyzed when the magnetic field 55 changes. For example, the control 40 may integrate the induced voltage in order to detect a relative change of the signal. The integrated voltage is then compared to a threshold value that is characteristic of the opening of the pressure-relief valve 50 by the control.

The sensor 60 may also comprise a hall effect sensor which reacts to the changes of the magnetic field. In this context, an analysis of the sensor signals may also take place in the manner described above.

Alternatively, the sensor 60 may comprise a reed switch which opens or closes an electrical contact at a certain strength of the magnetic field 55, i.e. at a certain distance between the permanent magnet 54 and the sensor 60. The switching of the reed switch may be recognized by the control 40.

Alternatively, the sensor 60 may also comprise an optical sensor (not shown) which senses the change of an optical property, for example a change in a light intensity. For example, an orifice plate might be attached at the valve piston 52 which orifice plate enters into the gap of a fork light sensor when the valve piston 52 shifts as the pressure-relief valve 50 opens.

Alternatively, the sensor 60 may also comprise an electric switch (not shown) which is mechanically actuated by the valve piston 52. For example, the electric switch may be arranged in such a manner that the valve piston 52 directly acts upon the electric switch when the piston shifts and switches the switch.

Alternatively, the sensor 60 may comprise a capacitive sensor (not shown). Thus, monitoring the state of the pressure-relief valve 50 may take place in a capacitive manner as well. The control 40 then measures the changeable electric capacitance of a capacitive sensor which, for example, is formed by the valve piston 52 as the movable part and an electrode connected to the housing as a stationary part. Then, by determining the electric capacitance between the valve piston and the electrode, the distance between the valve piston 52 and the electrode and, hence, the switching state of the pressure-relief valve 50 may be determined.

Based on the signal of the respective sensor 60, the control 40 controls the pressing process of the pressing tool 10. When the necessary pressing pressure is reached and the pressure-relief valve opens as the predefined pressure $P_v$ is reached, the control 40 may stop the motion of the electric motor 20 immediately or after a certain additional runtime has passed. In this way, the electric motor 20 is automatically switched off at the end of the pressing process by the control 40 and the user does not have to become active for this purpose. This improves the usability of the pressing tool 10 on the one hand and reduces power consumption on the other hand. Furthermore, in this way, the control 40 may fully automatically control the pressing process until it has successfully been concluded.

LIST OF REFERENCE NUMBERS

10 Pressing device/Pressing tool
20 Electric motor
22 Transmission
24 Eccentric
25 Working cylinder
26 Hydraulic system
27 Piston pump
28 Piston
29 Rollers
30 Attachment area for interchangeable tool
40 Control
50 Pressure-relief valve
51 Valve seat
52 Valve piston
54 Permanent magnet
55 Magnetic field
56 Spring
57 Dynamic pressure surface
58 Adjusting nut
60 Sensor
62 Stationary part/housing part

70 Hydraulic fluid

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A pressing tool for pressing workpieces, comprising:

a hydraulic pump for conveying a hydraulic fluid;

an electric motor for driving the hydraulic pump;

a working cylinder which is hydraulically connected to an outlet of the hydraulic pump;

a pressure-relief valve which is hydraulically connected to the outlet of the hydraulic pump and which opens at a certain predefined pressure ($P_v$) of the hydraulic fluid;

an electronic control for controlling the electric motor; and a sensor which directly monitors a state of the pressure-relief valve, wherein the sensor determines a distance (L) between a movable part of the pressure-relief valve and a part that is fixed with respect to the pressing tool, and wherein the sensor emits a signal which describes the state of the pressure-relief valve to the electronic control.

2. The pressing tool according to claim 1, wherein the pressure-relief valve comprises a movable valve piston which is preloaded against a valve seat by means of a spring.

3. The pressing tool according to claim 2, wherein the valve piston comprises a permanent magnet.

4. The pressing tool according to claim 1, wherein the sensor comprises a magnetic sensor which is influenced by a magnet at the pressure-relief valve.

5. The pressing tool according to claim 4, wherein the magnetic sensor comprises a hall effect sensor.

6. The pressing tool according to claim 4, wherein the magnetic sensor comprises a reed switch.

7. The pressing tool according to claim 4, wherein the magnetic sensor comprises an inductive sensor.

8. The pressing tool according to claim 1, wherein the sensor comprises an optical sensor.

9. The pressing tool according to claim 1, wherein the sensor comprises an electric switch.

10. The pressing tool according to claim 1, wherein the electric motor is a brushless DC motor.

11. A method of operating a pressing tool for pressing a workpiece, comprising:

driving a hydraulic pump by means of an electric motor;

conveying a hydraulic fluid by means of the hydraulic pump;

opening a pressure-relief valve which is hydraulically connected to an outlet of the hydraulic pump at a certain predefined pressure ($P_v$) of the hydraulic fluid;

directly monitoring a state of the pressure-relief valve by means of a sensor;

emitting a signal to an electronic control, wherein the signal describes the state of the pressure-relief valve; and controlling the electric motor by means of the electronic control based on the signal; and determining a distance (L) between a movable part of the pressure-relief valve and a part that is fixed with respect to the pressing tool by the sensor.

12. The method according to claim 11, wherein the step of determining the distance (L) takes place:

in an optical manner, wherein the sensor comprises an optical sensor;

in a magnetic manner, wherein the sensor comprises a magnetic sensor;

in a magnetic manner, wherein the sensor comprises a hall effect sensor;

in a magnetic manner, wherein the sensor comprises a reed switch;

in an inductive manner, wherein the sensor comprises an inductive sensor;

in an electro-mechanical manner, wherein the sensor comprises an electric switch; and/or in a capacitive manner, wherein the sensor comprises a capacitive sensor.

13. The method according to claim 11, wherein the sensor is adapted to detect both a closed and an open state of the pressure-relief valve.

14. The method according to claim 11, wherein the sensor is adapted to continuously detect the distance (L) between the movable part of the pressure-relief valve and the part that is fixed with respect to the pressing tool.

* * * * *